United States Patent [19]

Nishida et al.

[11] Patent Number: 4,547,906

[45] Date of Patent: Oct. 22, 1985

[54] HEAT RETAINING ARTICLE

[75] Inventors: Takeshi Nishida, Ibaraki; Yousuke Yamagami, Hikone; Toshihide Takeda; Toshio Saito, both of Nagahama, all of Japan

[73] Assignee: Kanebo, Ltd., Tokyo, Japan

[21] Appl. No.: 508,385

[22] Filed: Jun. 27, 1983

[51] Int. Cl.[4] ..... A41D 1/00

[52] U.S. Cl. ..... 2/93; 2/272; 2/2; 2/DIG. 3; 2/97; 5/455; 5/450; 5/449

[58] Field of Search ..... 2/93, 94, 97, 102, 267, 2/272, 2, DIG. 3, DIG. 10; 5/449, 450, 455

[56] References Cited

U.S. PATENT DOCUMENTS

| | | | |
|---|---|---|---|
| 633,968 | 9/1899 | Swartzwelder | 5/449 |
| 1,090,596 | 3/1914 | Bryers | 2/2 X |
| 2,608,690 | 9/1952 | Kolb et al. | 2/DIG. 3 X |
| 2,620,493 | 12/1952 | Brelsford | 5/450 |
| 3,112,956 | 12/1963 | Schick et al. | 5/455 X |
| 3,577,305 | 5/1971 | Hines et al. | 2/272 X |
| 3,771,170 | 11/1973 | Leon | 2/2 |
| 3,863,343 | 2/1975 | Malmin | 2/2 X |

FOREIGN PATENT DOCUMENTS

| | | |
|---|---|---|
| 55-24088 | 6/1980 | Japan . |
| 55-41766 | 9/1980 | Japan . |

*Primary Examiner*—Werner H. Schroeder
*Assistant Examiner*—J. L. Kravitz
*Attorney, Agent, or Firm*—Morgan, Finnegan, Pine, Foley & Lee

[57] ABSTRACT

The heat retaining article according to the invention comprises at least one inflatable envelope attached on a sheet material. The envelope is made of an air-impermeable sheet which is produced by treating a cloth with at least one synthetic or natural rubber. The heat retaining property of the article can be controlled by adjusting the amount of air filled in the envelope.

17 Claims, 10 Drawing Figures

FIG.1A
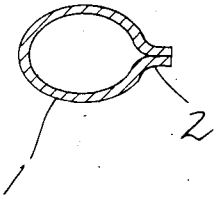
FIG.1B
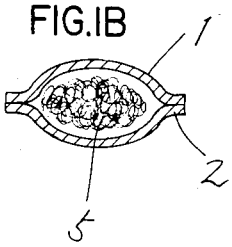
FIG.1C
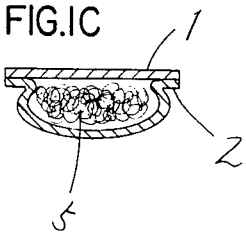
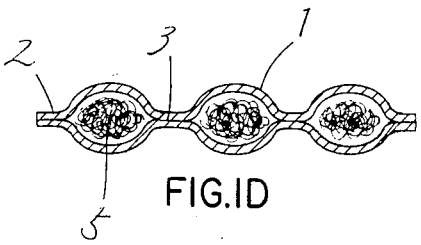
FIG.1D
FIG.1E
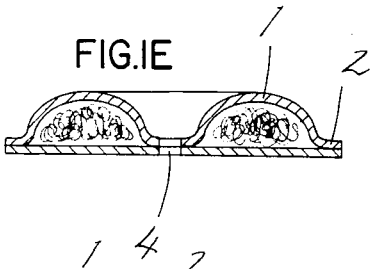
FIG.2B
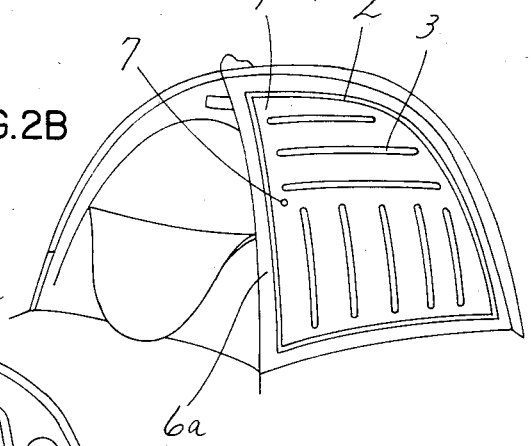
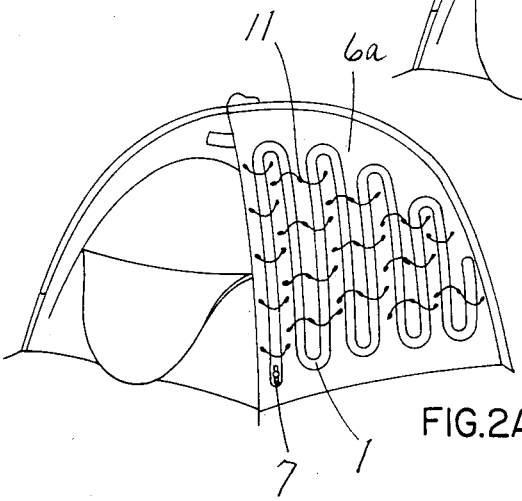
FIG.2A FIG.3
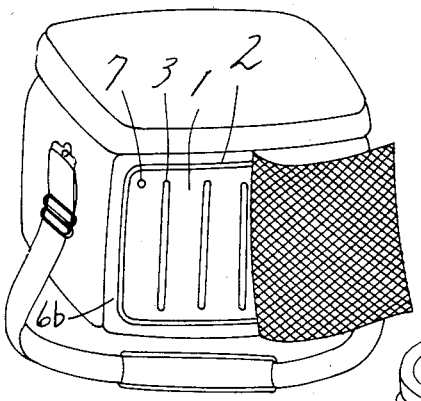
FIG.5A
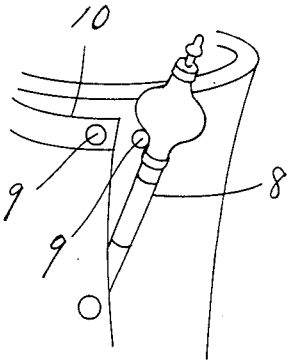
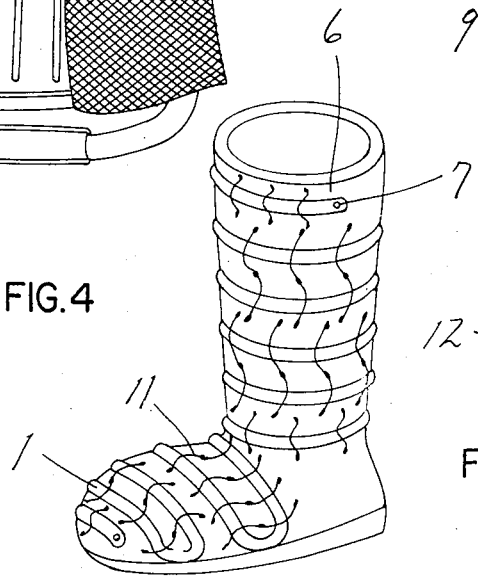
FIG.4
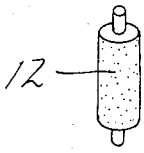
FIG.5B
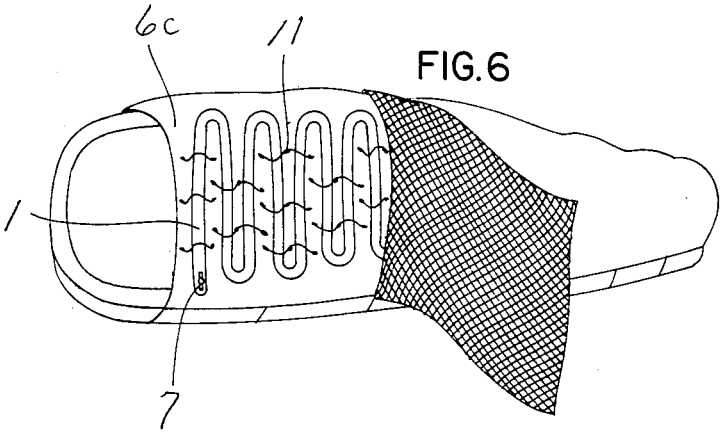
FIG.6

HEAT RETAINING ARTICLE

BACKGROUND OF THE INVENTION

This invention relates to a heat retaining article, and more particularly, to a heat retaining article in which the heat retaining property can be controlled.

In the past, the user of tents, sleeping bags and the like had to prepare at least two kinds of them, for use in winter and in summer, respectively. Even though the user possessed two kinds of such articles, he had to adjust the heat retaining property so as to adapt for the change of the climate, e.g. by using many clothes. Referring to conventional winter boots and gloves, it has been impossible to control the heat retaining property after the user put on them. Needless to say a portable ice box made as compact as possible is very easy to make, but is generally unnecessarily very thick and voluminous due to the use of heat insulators in anticipation of a change of temperature. Therefore, some restrictions have been imposed on use of such portable ice box.

On the other hand, as to garments, it has been well known to use quilted goods. More particularly, quilted goods comprising wool or down as wadding have a heat retaining property of Clo value 1 to 4 and are generally considered to have the best heat retaining property. However, they are voluminous and inconvenient for carrying. Further, the heat retaining property can not be controlled.

Japanese Utility Model Publication No. 41,766 of 1980 discloses a garment having an improved heat retaining property. However, the sleeves and body of the garment have air chambers consisting of surface and lining material made from an air-impermeable sheet. Accordingly, the surface and lining of the garment do not have sweat-absorbability and air-permeability and the garment is uncomfortable to wear. Furthermore, the figure of the garment is directly changed with the amount of air filled in the air chambers. The design of the garment is limited. It is not practically used.

An object of the invention is to provide a heat retaining article in which the heat retaining property can be controlled.

Another object of the invention is to provide an heat retaining article of clothing having a controllable heat retaining property which is comfortable to wear.

Other objects and advantages of the invention will be apparent from the following detailed description.

SUMMARY OF THE INVENTION

The heat retaining article according to the invention provided with at least one inflatable envelope attached on a sheet material. The envelope is made of an air-impermeable sheet which is produced by treating a cloth with at least one synthetic or natural rubber. The heat retaining property of the article can be controlled by adjusting the amount of air filled in the envelope.

The envelope may be tubular or divided into plural air chambers which are connected to each other. Further, the envelope may be comprises a wadding material therein to enhance the heat retaining property.

As cloths for making an inflatable envelope, there are included plain weave fabrics such as taffeta and oxford, twill fabrics, and knitted fabrics such as tricot and tubular knitting. Particularly, cloths made of synthetic fibers such as polyamide, polyester and the like are preferably used. The cloths are coated or laminated with at least one natural or synthetic rubber such as urethane and acrylic rubbers to be made air-impermeable. Tricot fabrics treated with an urethane rubber are most preferably used.

An inflatable envelope used in the invention may be formed by preparing double layers of thus treated cloth or an air-impermeable sheet and sealing the edges of them. No particular restrictions are imposed on the size of the envelope. Preferably, the envelope is tubular or divided into plural air-chambers which are connected to each other. In order to form the envelope, the treated cloths may be adhered with an adhesive or an adhesive sealing tape. However, it is preferred that the treated cloths are directly welded with a high-frequency welder or the like.

The envelope may comprise a wadding material therein to prevent the enclosed air from moving and to make the heat retaining property more effective. Appropriate wadding materials include cotton, silk, wool, and various staple fibers. Bulked continuous filaments called "BCF" may be used. Particularly, there are preferably used as the wadding material at least two polymers having different melting points and which are slightly welded by partially melting. For example, conjugated fibers which comprise two kinds of polymers having different melting points are put in the envelope as a wadding material and then the polymer having a lower melting point is melted by heating to weld the wadding material in part. The welding may be carried out either before or after inserting the wadding material into the envelope. The partially welded wadding material will be kept stably at the position in the envelope when air is blown into or out of the envelope. Therefore, even a small amount of the wadding material remarkably enhances the heat retaining property. The density of the wadding material put in the envelope is not particularly restricted, but preferably is from 0.001 to 0.05 g/cm$^3$ based on the volume of the inflated envelope.

The sheet material to which the inflatable envelope is attached may be a sheet material directly constituting the article according to the invention or an additional sheet material. A lot of materials such as cloths, woods, plastics, metals and the like are appropriate sheet materials, depending upon the intended use. However, cloths having air-permeability are preferably used for an article of clothing.

The envelope is preferably attached to the sheet material such that, when the envelope is filled with air, a portion of the envelope which does not face the sheet material is inflated and projects outwardly from the sheet but a portion of the envelope which does face the sheet material is substantially plain. This causes the control of the heat retaining property to be more effective. Particularly, when a large amount of air is filled in the envelope, the adjacent inflated portions of the envelope or envelopes approach each other and come into close contact with each other to achieve the maximum heat insulating property.

The diameter of the tubular envelope or air chamber is not limited, but preferably is within the range of 5 to 500 mm. For example, preferable diameters include 5 to 100 mm for cloths, 20 to 500 mm for tents, 10 to 60 mm for ice boxes, 5 to 40 mm for winter boots and 30 to 200 mm for sleeping bags.

The envelope has at least one air inlet. The amount of air inside the envelope is controlled through the air inlet. A connecting part made of soft resins or the like may be attached to the air inlet so that air may be blown into the envelope through the connecting part.

According to the invention, the envelope can be simply attached to a sheet material. Therefore, a heat retaining material according to the present invention can be applied in any desired configuration not only to cloths, but also to non-clothing items such as tents, bags, sleeping bags, shoes, curtains, mats, ice boxes and other articles requiring a heat retaining on insulating property.

The inflatable envelope can be attached to a sheet material, e.g., by adhering or sewing the sealed edges and/or partitions of the envelope to the sheet material. A thread, string, tape or the like may be used to fix the envelope to the sheet material, depending on the shape of the envelope.

The heat retaining article according to the invention can be made of a compact material suitable for storage or carrying when it is not used. The heat retaining article can be used as a thin material by deflating air from the envelope or, if necessary a high heat retaining property can be obtained by admitting air into the envelope.

Thus, the article according to the invention is very easily handled and is available for multiple applications. The heat retaining property can be regulated to obtain a level comparable to that of a quilting material employing wool or down as a pad. An acceptable appearance of the heat retaining article according to the invention can be maintained whether air is admitted into the envelope or not.

BRIEF DESCRIPTION OF THE DRAWINGS

The invention will be further described with reference to the accompanying drawings.

FIGS. 1A to 1E are sectional views of inflatable envelopes according to the invention.

FIGS. 2A and 2B are perspective views of tents according to the invention;

FIG. 3 is a perspective view of a portable ice box according to the invention;

FIG. 4 is a perspective view of boots according to the invention;

FIG. 5A is a partially enlarged perspective view of the boots shown in FIG. 4;

FIG. 5B is a perspective view of a cartridge to be attached to air inlet of the boots shown in FIG. 5;

FIG. 6 is a perspective view of a sleeping bag according to the invention;

DETAILED DESCRIPTION OF THE PREFERRED EMBODIMENTS

Figure 7A:
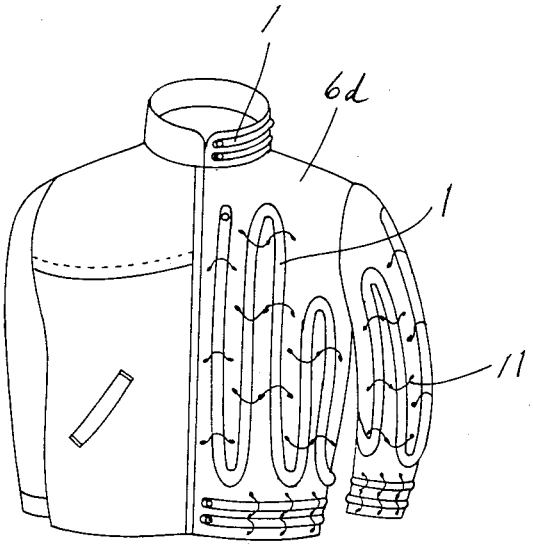
FIGS. 7A and 7B are perspective views of jackets according to the invention.

FIGS. 1A to 1C show tubular envelopes (1) and FIGS. 1D and 1E show envelopes (1) divided into plural air chambers which are connected to each other. The envelopes (1) are formed by sealing the edges (2) and the portions which form partitions (3) from air-impermeable sheets which are made by treating a cloth with a natural or synthetic rubber. The envelopes (1) in FIGS. 1B to 1E are shown provided with a wadding material (5). The envelope (1) in FIG. 1E has a nick (4) which is formed by partially cutting out the air-impermeable sheet.

Each of the tents shown in FIGS. 2A and 2B is a double tent having an envelope (1) attached to the inside layer (*6a*). The envelope (1) in FIG. 2A is tubular and is attached to the sheet by thread (11). The envelope (1) in FIG. 2B is divided into plural chambers with partitions (3). Air can be blown into the envelope (1) through an air inlet (7).

FIG. 3 shows a portable ice box, in which an inflatable envelope (1) divided by partitions (3) is attached to the side board (*6b*).

FIG. 4 shows winter boots with a tubular envelope (1) attached to sheet material (6) by a thread (11) in accordance with the invention. The envelope (1) on a sheet material (6) is covered with an outer skin not shown in FIG. 4. As shown in FIG. 5A a connecting part (8) made of a resin may be attached to the air inlet (7). Connecting part (8) may be kept in a pocket (10) which is opened or shut with stoppers (9). As shown in FIG. 5B, a cartridge (12) comprising a moisture absorbent may be attached to the air inlet (7) to prevent the moisture in breath from freezing when the envelope is inflated with exhaled breath in very cold weather.

FIG. 6 shows a sleeping bag with a tubular envelope (1) attached to a fabric (6C) with a thread (11). A partially removed cover layer is also shown.

Figure 7B:
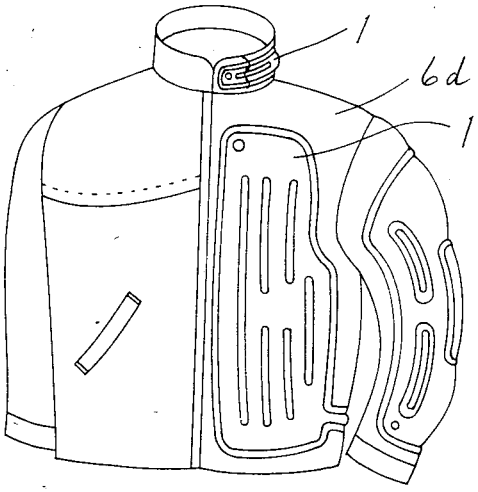
Figure 9:
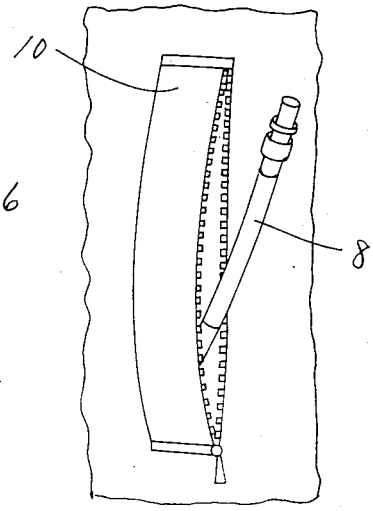
FIG. 9 is a partial enlarged view of the jacket shown in FIG. 8.
Figure 10:
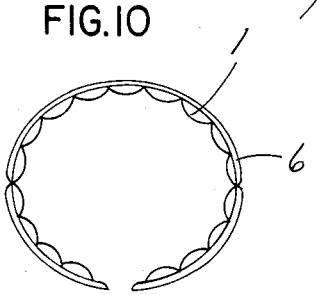
FIG. 10 is a cross-sectional view of a jacket according to the invention.
Figure 8:
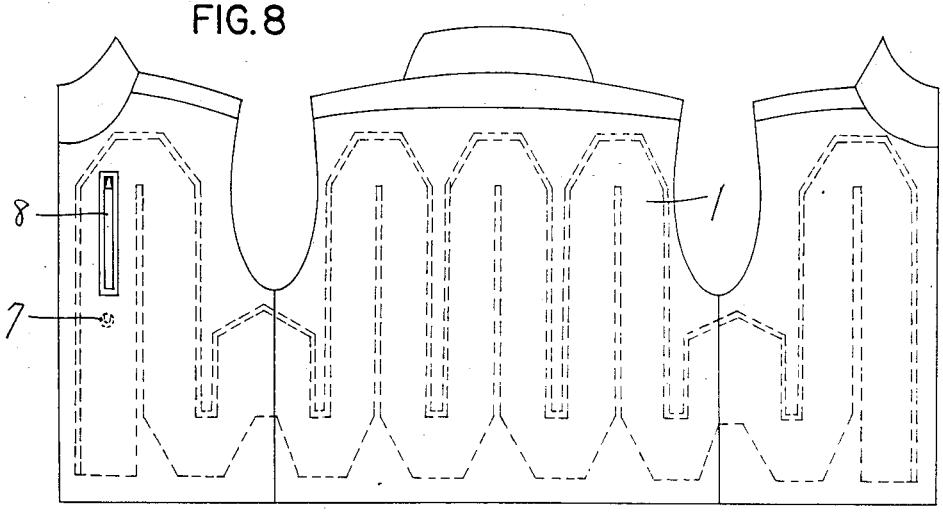
FIG. 8 is a plan view of a jacket pattern according to the invention.

FIGS. 7A, 7B and 8 show jackets in which an envelope (1) is attached to an air-permeable cloth lining (*6d*). The jackets are comfortable to wear. The jacket in FIG. 8 has a connecting part (8) attached to the air inlet (7) and kept in a pocket (10). (See FIG. 9). The envelope (1) can be inflated by breathing into connecting part (8) while wearing the jacket at any desired time. Furthermore, as shown in FIG. 10 it is preferred in jackets that the envelope (1) be attached to sheet material (6) such that, when filled with air, the envelope (1) is inflated and projects into the jacket toward the wearer. The portion of the envelope attached to sheet material (6) is not substantially inflated. This manner of inflation allows the heat retaining property to be controlled over a wide range while maintaining the aesthetic appearance of the jacket.

The following examples serve to illustrate the invention in more detail although the invention is not limited to the examples.

EXAMPLE 1

A polyamide half-tricot fabric was laminated with a polyurethane film. Two laminated fabrics were brought together so that the urethane coated sides faced each other and the edges of the fabrics were sealed with a high-frequency welder to produce a tubular envelope similar to that shown in FIG. 1A having a diameter of 45 mm. 10 parts of conjugated short fibers comprising two polyesters which have melting points of 260° C. and 110° C. and 90 parts of usual polyester short fibers were mixed and heated to obtain partially welded wadding material. The wadding material was inserted into the tubular envelope in an density of 0.01 g/cm$^3$ based on the volume of the inflated envelope. The tubular envelope was attached to a jacket so that the inflated portion was projected inside the jacket as shown in FIGS. 8 and 10. The heat insulating property of the jacket in which the envelope was filled with air was measured by JIS L 1097-1979 6.28.1.(A method). The result is shown in comparison with the jacket without the tubular envelope as follows:

| | heat insulating property (Clo value) |
|---|---|
| Jacket with the tubular envelope | 2.5 |
| Jacket without the tubular envelope | 0.5 |

The jacket with the tubular envelope was worn at −10° C. and the envelope was filled with air. The infrared image photographs illustrating the state of heat released from the body were examined in comparison with the state of wearing the jacket in which air was completely exhausted from the tubular envelope.

The surface temperature of the jacket with the inflated envelope was substantially identical with the room temperature. However, wearing the jacket with the uninflated tubular envelope, the amount of heat released from the body became large. The difference between the surface temperature of the jacket and the room temperature was about 14° C.

It is understood from these results that the heat insulating property of the jacket according to the invention can be effectively controlled by adjusting the amount of air in the envelope.

EXAMPLE 2

A polyamide half-tricot fabric was laminated with a polyurethane film. An envelope divided into plural air chambers connected to one another was prepared by welding two laminated fabrics as illustrated in FIG. 1D. The same wadding material as in Example 1 was inserted into the bag. The density of the wadding material was 0.01 g/cm$^3$ based on the volume of the inflated envelope. The envelope was attached to a jacket as illustrated in FIG. 7B. The diameter or thickness of the inflated envelope was 40 mm. The heat insulating property of the upper garment was measured by the same manner as in Example 1. The result is shown in comparison with the jacket without the envelope as follows:

| | heat insulating property (Clo value) |
|---|---|
| Jacket with the envelope | 2.2 |
| Jacket without the envelope | 0.5 |

It is understood from the above result that the heat retaining property is increased by attaching the envelope.

Further, the state of heat released from the body was examined in the same manner as in Example 1. A similar result to that in Example 1 was obtained.

EXAMPLE 3

The same tubular envelope as in Example 1 was attached to a bag. A soybean soup at 80° C. was put in an aluminum vessel of 10 liters and allowed to stand for 3 hours in a room at −20° C. and, consequently, the temperature of the soup was reduced to 20° C. However, when the aluminum vessel was put in the above bag with the envelope inflated and allowed to stand for 3 hours in a room at −20° C., the drop in temperature of the soup was only 15° C. and the temperature of the soup was 65° C. It is calculated from this result that the bag had a heat insulating property of Clo value 2.5.

EXAMPLE 4

A tubular envelope having a diameter of 100 mm was prepared by the same manner as in Example 1. The same wadding material as in Example 1 was inserted into the tubular envelope in an density of 0.01 g/cm$^3$ based on the volume of the inflated tubular envelope. The tubular envelope was attached to a sleeping bag as illustrated in FIG. 6. The heat released from the body in the sleeping bag at −10° C. was examined with infrared image photographs in the same manner as in Example 1. It was observed that the sleeping bag had a heat insulating property the same or greater than that exhibited by commercial sleeping bags, although the former sleeping bag according to the invention could be kept in a volume of about 1/10 of the latter commercial sleeping bags upon storage and was very portable.

What we claim is:

1. A heat retaining article comprising at least one inflatable envelope attached to a sheet material, said envelope being made of an air-impermeable sheet consisting of a cloth treated with at least one synthetic or natural rubber, said envelope containing a wadding material consisting of at least two polymers having different melting points, one of said polymers having been melted to partially weld said wadding, thereby substantially preventing said wadding from moving about within said envelope, the heat retaining property of said article being controlled by adjusting the amount of air in said envelope.

2. The heat retaining article according to claim 1, wherein the density of said wadding material is from 0.001 to 0.05 g/cm$^3$ based on the volume of the inflated envelope.

3. The heat retaining article according to claim 1, wherein said envelope is tubular.

4. The heat retaining article according to claim 3, wherein said tubular envelope has a diameter of from 5 to 500 mm.

5. The heat retaining article according to claim 1, wherein said envelope is divided into plural air chambers connected to each other.

6. The heat retaining article according to claim 1, wherein said envelope is attached to said sheet material such that, when said envelope is filled with air, a portion of said envelope which does not face said sheet material is inflated and projects away from said sheet material but the portion of said envelope which does face said sheet material is substantially plain.

7. The heat retaining article according to claim 1, wherein said article is a tent, a sleeping bag, boots, a bag, a portable ice box or an article of clothing.

8. The heat retaining article according to claim 1, wherein said wadding material comprises conjugate fibers.

9. A heat retaining article of clothing comprising at least one tubular envelope attached to a sheet material, said envelope being made of an air-impermeable sheet consisting of a cloth treated with at least one synthetic or natural rubber, said envelope containing a wadding material consisting of at least two polymers having different melting points, one of said polymers having been melted to partially weld said wadding, thereby substantially preventing said wadding from moving about within said envelope, the heat retaining property of said article of clothing being controlled by adjusting the amount of air in said envelope.

10. The heat retaining article of clothing according to claim 9, wherein the density of said wadding material is from 0.011 to 0.05 g/cm$^3$ based on the volume of the inflated envelope.

11. The heat retaining article of clothing according to claim 9, wherein said tubular envelope has a diameter of from 5 to 100 mm.

12. The heat retaining article of clothing according to claim 9, wherein said tubular envelope is attached to said sheet material such that, when said envelope is filled with air, a portion of said envelope which does not face said sheet material is inflated and projects away from said sheet material but the portion of said envelope which does face said sheet material is substantially plain.

13. The heat retaining article of clothing according to claim 9, wherein said article is a garment having wadded shoulders.

14. The heat retaining article according to claim 9, wherein said wadding material comprises conjugate fibers.

15. A heat retaining article of clothing comprising at least one inflatable envelope attached to a sheet material, said envelope being divided into plural chambers which are connected to each other, said envelope being made of an air-impermeable sheet consisting of a cloth treated with at least one synthetic or natural rubber, said envelope containing a wadding material consisting of at least two polymers having different melting points, one of said polymers having been melted to partially weld said wadding, thereby substantially preventing said wadding from moving about within said envelope, the heat retaining property of said article of clothing being controlled by adjusting the amount of air in said envelope.

16. The heat retaining article according to claim 15, wherein the density of said wadding is from 0.001 to 0.05 g/cm$^3$ based on the volume of the inflated envelope.

17. The heat retaining article according to claim 15, wherein said wadding material comprises conjugate fibers.

* * * * *